US006042029A

United States Patent [19]

Massey

[11] Patent Number: 6,042,029

[45] Date of Patent: Mar. 28, 2000

[54] DUAL-OUTLET FIRE SERVICE LINE CONNECTOR

[76] Inventor: Marvin E. Massey, 2635 Webb, Detroit, Mich. 48206

[21] Appl. No.: 09/049,431

[22] Filed: Mar. 27, 1998

[51] Int. Cl.[7] ..... B05B 15/08; A62C 31/02

[52] U.S. Cl. ..... 239/587.1; 239/548; 239/565; 239/587.2; 239/587.5; 239/588; 239/589

[58] Field of Search ..... 239/565, 587.1, 239/587.2, 587.5, 548, 588, 589

[56] References Cited

U.S. PATENT DOCUMENTS

| | | | |
|---|---|---|---|
| 641,295 | 1/1900 | Jackson . | |
| 927,837 | 7/1909 | Delene . | |
| 2,419,393 | 4/1947 | Doyle . | |
| 2,569,378 | 9/1951 | Hood . | |
| 2,683,626 | 7/1954 | Wahlin | 239/565 X |
| 2,851,305 | 9/1958 | Martinez | 239/587.2 X |
| 3,448,809 | 6/1969 | Lambert et al. . | |
| 3,567,136 | 3/1971 | Garrett | 239/587.2 |
| 4,183,410 | 1/1980 | Dion-Biro | 239/587.2 X |
| 4,187,913 | 2/1980 | Wilcox . | |
| 4,865,254 | 9/1989 | Kragle . | |
| 5,386,942 | 2/1995 | Dietle | 239/565 X |

*Primary Examiner*—Andres Kashnikow
*Assistant Examiner*—Robin O. Evans
*Attorney, Agent, or Firm*—Brooks & Kushman P.C.

[57] ABSTRACT

A connector for connecting a pair of firefighting nozzles to a fire service line includes a single inlet and a pair of outlets in fluid communication with the inlet. Each outlet forms the terminal end of a generally tubular arm whose inner diameter is substantially similar to that of the inlet. One arm includes a joint, whereby the one arm may be selectively articulated relative to the other arm from a first position in parallel relation to the other arm to a second position forming an angle of up to about 90 degrees with respect to the other arm. Preferably, the arms are of dissimilar length, with the articulatable arm extending to a point farther removed from the inlet than the other arm when the articulatable arm is in its first position relative to the other arm.

16 Claims, 1 Drawing Sheet

DUAL-OUTLET FIRE SERVICE LINE CONNECTOR

TECHNICAL FIELD

The invention relates to apparatus for connecting a pair of firefighting nozzles to a single fire service line and, more particularly, to a fire service line connector that permits one nozzle to be selectively pivoted or articulated relative to the other nozzle such that the one nozzle's axis of effluent flow is either parallel to, or makes an adjustable angle of preferably up to about ninety degrees with respect to, the axis of effluent flow of the other nozzle.

BACKGROUND ART

Known firefighting equipment includes flexible conduits, hoses or "lines" of various diameters with which to deliver water or other firefighting agents from a source of supply directly to a fire. Generally, the lines fall within two categories: the first category includes relatively larger internal diameter, higher-capacity "feed" lines, while the second category includes relatively smaller internal diameter, lower-capacity "service" lines.

By way of example only, in the United States, standard feed lines typically have an inner diameter of about 2.5 inches (about 64 mm) or greater. Standard service lines typically have an inner diameter of about 1.5 to 1.75 inches (about 38 to 44 mm). Feed lines are often used to connect a fire hydrant to a pumper truck, and to otherwise form the first portion of the highly-pressurized line extending from the pumper truck to a diameter-reducing distribution manifold, to which perhaps as many as four or five of the smaller-diameter service lines may be connected. Generally, feed lines become relatively rigid and immovable when pressurized with these firefighting agents, while the relatively-smaller-diameter service lines connected to the feed lines (or individually connected directly to high pressure supply or pumper truck) remain relatively flexible. Firefighting nozzles are thus normally connected to these relatively flexible service lines, one nozzle per service line, for manipulation by individual firefighters.

Known firefighting nozzles typically operate to generate an effluent flow along a nominal axis, the general composition of which may be adjusted to achieve either a relatively narrow pattern or "stream" or a relatively wide pattern or "fog." An effluent stream is the preferred nozzle setting for "stomping out" the flames emanating directly from a burning object. An effluent fog is the preferred nozzle setting for blowing or "fogging" the smoke and heat generated by a burning object away from that object or its environs (as when blowing smoke and heat out of a room within a burning structure through a window, door or other opening).

Consequently, when a fire in a given location, for example, in a room within a burning structure, requires either two effluent streams or the combination of an effluent stream and an effluent fog—even for a relatively short period of time—the prior art teaches use of two separate fire service lines, each manned by its respective firefighter. The use of dual service lines necessarily requires twice as much equipment and manpower, with the further disadvantage that many locations, such as attics and other tight spaces, provide little room for such added firefighting equipment and personnel.

Often, however, it is not possible to direct two service lines into each such location due to limitations on either equipment or personnel and, hence, the nozzle attached to a single service line must alternatively generate both the effluent stream and the effluent fog. As a result, the fire is extinguished less quickly, with more damage to the burning structure and greater attendant risk to firefighting personnel. The inability to control smoke and heat on an ongoing basis further deleteriously and, in view of the invention, needlessly contributes to firefighter fatigue and injury.

DISCLOSURE OF INVENTION

It is an object of the invention to provide a connector for a fire service line which permits placement of two firefighting nozzles on a single fire service line.

It is another object of the invention to provide a fire service line connector which allows a single firefighter to conveniently and, where desired, simultaneously operate a pair of firefighting nozzles fed by a single fire service line.

It is yet another an object of the invention to provide a fire service line connector which allows a single firefighter to generate, with a single fire service line, both an effluent stream and an effluent fog.

It is also an object of the invention to provide a fire service connector which allows a single firefighter to direct effluent flow from a first nozzle in a first direction while simultaneously directing effluent flow from a second nozzle in either the first direction or in a second direction up to ninety degrees off of the first direction.

It is a further object of the invention to provide a fire service line connector which allows a single firefighter to direct an effluent stream from a first nozzle in a first direction while simultaneously directing an effluent fog from a second nozzle in either a the first direction or in a second direction up to ninety degrees off of the first direction.

Under the invention, a fire service line connector has an inlet and a pair of outlets, wherein the first outlet forms the terminal end of a first arm and the second outlet forms the terminal end of a second arm. The first outlet of the connector itself defines a first outlet axis and the second outlet defines a second outlet axis. In accordance with the invention, the first arm of the connector is articulatable relative to the second arm such that is may be articulated from a first position, in which the first outlet axis is in parallel-spaced relation to the second outlet axis, to a second position, in which the first outlet axis forms an nonzero angle with the second outlet axis, preferably of up to about 90 degrees.

Preferably, the first arm articulates at a joint, and a grip is provided on the first arm between the joint and the first outlet to facilitate articulation of the first arm relative to the second arm. A handle also extends from the bight portion of the connector located between the two arms to further improve grip.

In accordance with another feature of the invention, the first, articulatable arm of the connector extends to a point farther removed from the inlet than the second arm when the first arm is in its first position relative to the second arm.

While the arms of the connector may be roughly the same length, in accordance with another feature of the invention, one arm is substantially longer than the other such that an effluent stream emanating from a nozzle attached to the shorter arm will itself "cut out" less of the effluent fog emanating from a nozzle attached to the longer arm. Most preferably, the longer leg is also the leg which may be articulated relative to the other, shorter leg.

While an exemplary connector is illustrated and disclosed, such disclosure should not be construed to limit the claims. It is anticipated that various modifications and alternative designs may be made without departing from the scope of the invention.

BEST MODE FOR CARRYING OUT THE INVENTION

Figure 1:
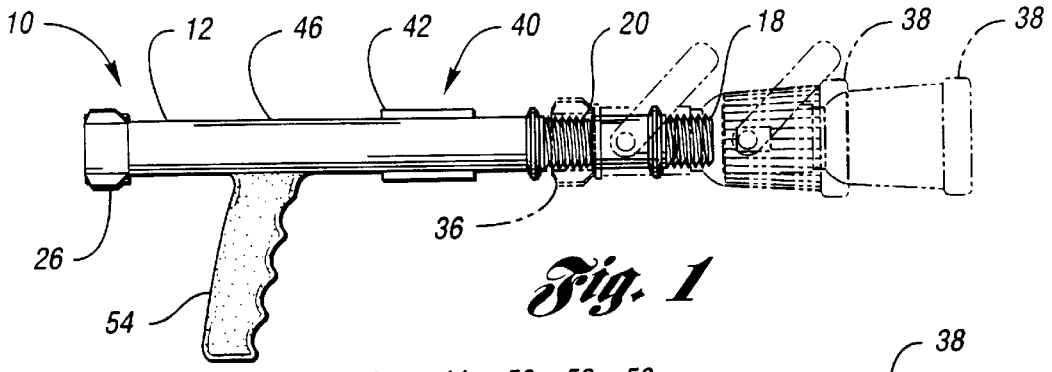
FIG. 1 is a side view in elevation of an exemplary fire service line connector in accordance with the invention, further showing in phantom a pair of nozzles threadably coupled to each of the connector's outlets.
Figure 2:
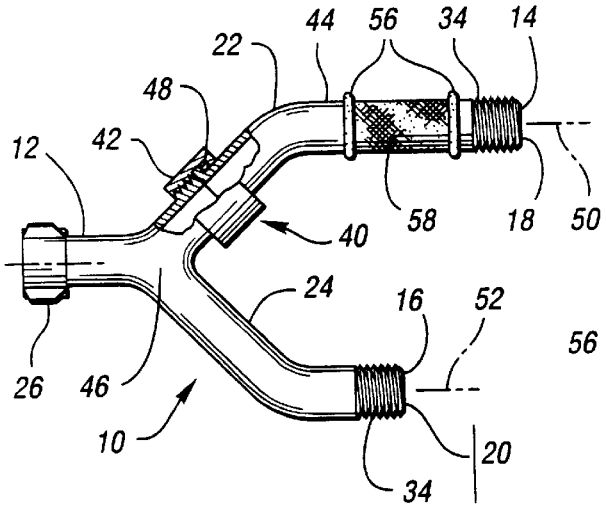
FIG. 2 is a top plan view, partially broken away, of the exemplary connector of FIG. 1.

Referring to FIGS. 1 and 2, an exemplary connector 10 in accordance with the invention includes a single inlet 12, and a pair of outlets 14,16 in fluid communication with the inlet 12. More specifically, each outlet 14,16 forms the terminal end 18,20 of each of two tubular arms 22,24. Each arm 22,24 has an inner diameter which approximates the nominal inner diameter of the inlet 14. It will thus be appreciated that the present connector 10 forms a nonreducing fluid coupling between the single inlet 12 and the two outlets 12,16.

Figure 3:
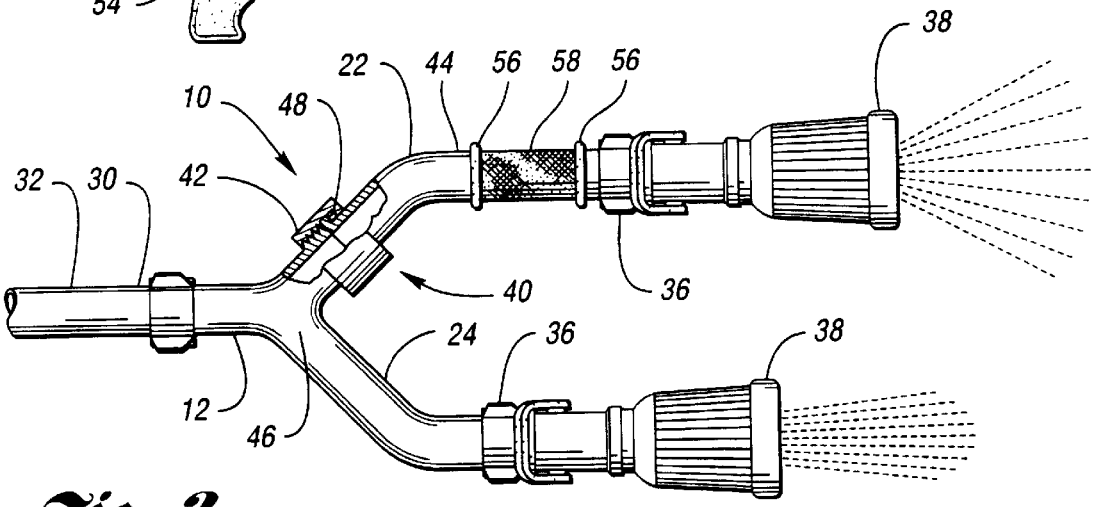
FIG. 3 is a top plan view of the exemplary connector of FIG. 1 when coupling a fire service line to a pair of nozzles, wherein the first nozzle generates an effluent stream in a first direction and the second nozzle generates an effluent fog also in the first direction.

An internally threaded collar 26 seated on an external flange on the connector 10 proximate to the inlet 12 is used to threadably couple the connector's inlet 12 to an externally-threaded end 30 of a fire service line 32, as illustrated in FIG. 3. An external thread 34 is similarly defined on each arm 22,24 proximate its terminal end 18,20, i.e., adjacent to each outlet 14,16. The terminal end 18,20 of each arm 22,24 is thus adapted to be threadably received within the enlarged, internally-threaded end 36 of a standard adjustable firefighting nozzle 38 (an pair of exemplary nozzles 38 are illustrated in phantom lines in FIG. 1, and in solid lines in FIGS. 3 and 4).

While the invention contemplates use of any suitable arrangement whereby a joint 40 is defined between the terminal end 18 of the first arm 22 and the rest of the connector 10, in the exemplary connector 10 shown in the Drawings, a threaded sleeve 42 removably secures the main length 44 of the first arm 22 to the bight portion 46 of the connector 10 defined between the connector's two arms 22,24. An O-ring 48 disposed between complementary radial flanges on the sleeve 42 and the first arm's main length 44 provides the resulting joint 40 with a fluid-tight seal. It will be readily appreciated that, given the relatively harsh firefighting environment in which the exemplary connector 10 is intended to be used, the joint 40 may preferably incorporate other known design expedients, including but not limited to self-lubricating fittings and ball bearings, and/or utilize other known joint designs to ensure that the joint 40 remains operative over a wide range of operating conditions.

Figure 4:
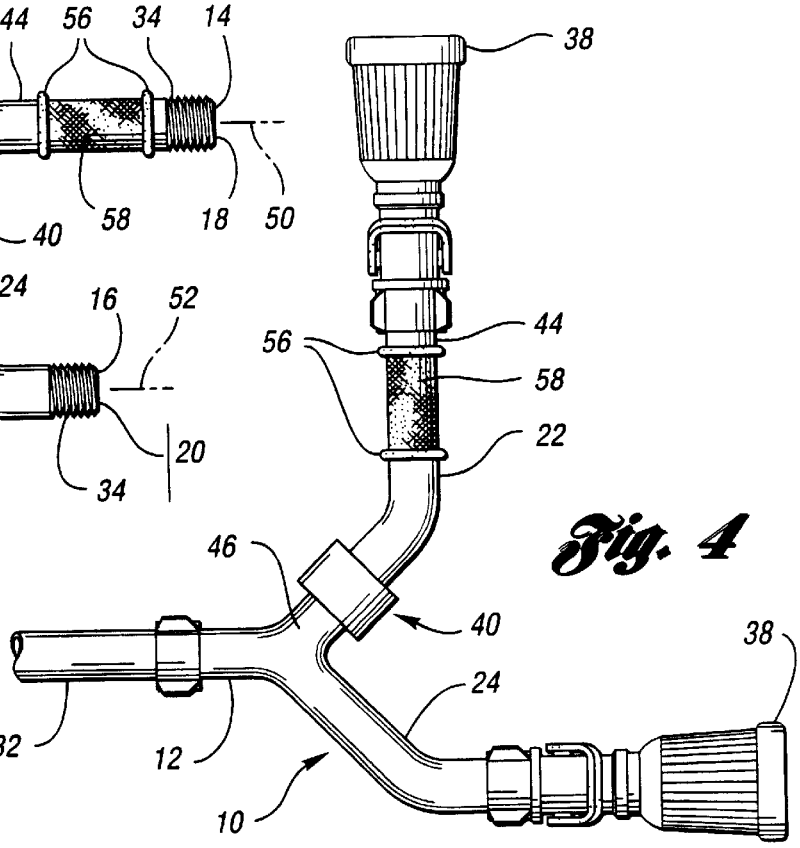
FIG. 4 is a top plan view of the exemplary connector similar to that shown in FIG. 3, except that the second nozzle now generates an effluent fog in a second direction roughly ninety degrees off of the first direction in which the first nozzle's effluent stream is generated.

The resulting joint 40 permits rotation of the first arm's main length 44 relative to the connector's bight portion 46 and, hence, the repositioning of the first arm's outlet axis 50 relative to the second arm's outlet axis 52. As seen clearly in FIGS. 2 and 3, the first arm 22 of the exemplary connector 10 rotates in a plane forming roughly a 45 degree angle with respect to the first arm's outlet axis 50, and the main length 44 of the first arm 22 likewise includes a nominal 45 degree bend. As a result, the main length 44 of the first arm 22 and, hence, its outlet axis 50, may be articulated about the joint 40 from a first position in parallel-spaced relation with the second arm's outlet axis 52 (as clearly shown in FIGS. 2 and 3) to a second position in which the first arm's outlet axis 50 forms an angle of up to about 90 degrees with the second arm's outlet axis 52 (as shown in FIG. 4).

As noted above, the invention contemplates joint designs and materials whereby the joint 40 remains operative notwithstanding the harsh firefighting environment. Moreover, the joint 40 may preferably be articulated when the service line 32 and, hence, the connector 10 is charged with the selected firefighting agent (typically water under pressure), even when each of the nozzles 38 is closed. Alternatively, a separate valve or gate (not shown) may be interposed between the connector 10 and the service line 32 to shut off the flow of the firefighting agent to the connector 10 prior to articulating the first arm's main length 44 at the joint 40, whereby the static pressure within the connector 10 during such articulation may be greatly reduced.

In accordance with another feature of the invention, when the first arm's main length 44 is articulated such that the first arm's outlet axis 50 extends in the same direction as the second arm's outlet axis 52 (as illustrated in FIGS. 1–3), the first arm 22 extends farther from the connector's bight portion 46 than the second arm 24. In this way, the first arm 22 of the exemplary connector 10 is said to be significantly longer than the connector's second arm 24.

When nozzles 38 are respectively mounted on the terminal ends 18,20 of the arms 22,24 and both an effluent stream and an effluent fog are desired, the nozzle 38 on the first arm 22 is preferably set to fog while the nozzle 38 on the second arm 24 is set to stream, as illustrated in FIG. 3. In this manner, the effluent stream generated by the second arm's nozzle 38 will "cut out" a relatively small portion of the effluent fog generated by the first arm's nozzle 38 and, hence, minimally impact the effectiveness of the fog.

In accordance with another feature of the invention, the exemplary connector 10 further includes a "pistol-grip" handle 54 which extends from the connector's bight portion 46 roughly perpendicularly from the plane generally defined by the connector's two arms 22,24 when both arms 22,24 extend in the same direction (as seen in FIGS. 1–3). The handle 54 provides a firefighter with a convenient grip while further providing the connector 10 with a steadying device, whereby a firefighter may transfer at least a portion of the reaction force generated by the nozzles' effluent flows to another structure, for example, a door or window frame, or the like (not shown).

The first, articulatable arm 22 of the exemplary connector 10 also includes a pair of radial flanges or "gripping rings" 56 spaced along on the first arm's main length 44 between the joint 40 and its outlet 16. The gripping rings 56 provide increased control of the effluent flow emanating from each attached nozzle 38 while providing a convenient purchase by which to effect relative articulation of the first arm 22 at the joint 40, even with the typically gloved hand of a firefighter. A nonskid surface 58 on the first arm 22 between the gripping rings 56 also serves to provide improved grip.

While an exemplary embodiment of the invention has been illustrated and described, it is not intended that this embodiment illustrate and describe all possible forms of the invention. Rather, it is intended that the following claims cover all modifications and alternative designs, and all equivalents, that fall within the spirit and scope of this invention.

For example, while FIG. 3 illustrates a connector 10 used to generate an effluent fog with the nozzle 38 attached to the connector's relatively-longer articulatable first arm 22 and an effluent stream with the nozzle 38 attached to the connector's relatively-shorter arm 24, it will be appreciated that the invention contemplates use of the exemplary connector 10 to generate an effluent fog from the shorter arm's nozzle 38, or two effluent fogs, or two effluent streams. The invention further contemplates the selective operation of the nozzles, whereby one or the other of the nozzles is shut off to thereby generate but a single effluent flow (stream or fog) from one nozzle, whereby the flow rate through that one operating nozzle may be maximized. Similarly, while only the first arm 22 of the exemplary connector 10 is articulatable relative to the connector's bight portion 46, the invention contemplates definition of an articulatable joint 40 between each arm 22,24 and the bight portion 46 of the connector. In this regard, it is noted that the use of one or more articulatable joints 40 permits the replacement or substitution of a given arm 22,24 with one of either similar or dissimilar length, whereby the relative lengths of the first and second arms 22,24 may be readily adjusted. Moreover, such replacement or substitution of a given arm 22,24 permits the use of nozzles 38 which are integrally formed on what would otherwise be the terminal ends 18,20 of those arms 22,24.

I claim:

1. A connector for removably coupling a pair of nozzles to an end of a flexible fluid supply conduit, wherein the fluid supply conduit has a nominal internal diameter, the connector comprising:

a generally tubular inlet defining an inlet axis, and a pair of generally tubular outlets in fluid communication with the inlet, each outlet having a nominal internal diameter substantially equal to the nominal internal diameter of the fluid supply conduit, wherein the first outlet forms the terminal end of a first arm and defines a first outlet axis, and the second outlet forms the terminal end of a second arm and defines a second outlet axis in fixed parallel-spaced relation with the inlet axis, and wherein the first arm is articulatable relative to the second arm from a first position to a second position, the first position being characterized in that the first outlet axis is in parallel-spaced relation with the second outlet axis, and the second position being characterized in that the first outlet axis forms an nonzero angle with the second outlet axis.

2. The connector of claim 1, wherein the first outlet extends to a point farther removed from the inlet than the second outlet when the first arm is in the first position relative to the second arm.

3. The connector of claim 1, wherein the first arm articulates at a joint, and further including a grip on the first arm between the joint and the first outlet.

4. The connector of claim 1, including a threaded collar seated for rotation on the connector proximate to the inlet for securing the connector to an end of the fluid conduit, and including an external thread on the connector housing proximate to each outlet to respectively receive the nozzles thereon.

5. A hand-held firefighting apparatus adapted to be connected to a flexible fluid supply conduit, the apparatus having an generally tubular inlet extending along an inlet axis, and a pair of generally tubular outlets in fluid communication with the inlet, the inlet and each of the outlets having substantially equal inner diameters, wherein the first outlet forms the terminal end of a first arm extending along a first outlet axis and the second outlet forms the terminal end of a second arm extending along a second outlet axis, the second outlet axis being fixed in relation to the inlet axis, and the first arm being articulatable relative to the second arm from a first position in parallel-spaced relation with the second arm to a second position forming a nonzero angle with respect to the second arm.

6. The apparatus of claim 5, wherein the first outlet extends to a point farther removed from the inlet than the second outlet when the first arm is in the first position relative to the second arm.

7. The apparatus of claim 5, wherein the inlet has an inner diameter, and wherein the first and second arms respectively have an inner diameter substantially equal to the inner diameter of the inlet.

8. The apparatus of claim 5, wherein the first arm articulates at a joint, and further including a grip on the first arm between the joint and the first outlet.

9. The apparatus of claim 5, further including a nozzle on the end of each arm.

10. The apparatus of claim 5, wherein the second outlet axis is fixed in parallel-spaced relation to the inlet axis.

11. A firefighting apparatus comprising:

a flexible fluid supply conduit including an end having a nominal inner diameter;

a pair of adjustable-flow nozzles, each nozzle including a nozzle inlet having a nominal inner diameter substantially equal to the nominal inner diameter of the end of the fluid supply conduit, and a nozzle outlet substantially collinear with the nozzle inlet;

a connector having a generally tubular inlet extending along an inlet axis and adapted to removably couplingly receive the end of the supply conduit, the connector further including a pair of generally tubular outlets respectively defining a first and second outlet axis, each outlet of the connector being in fluid communication with the inlet of the connector, each outlet of the connector being adapted to removably couplingly engage a respective nozzle inlet, wherein the first outlet of the connector forms the terminal end of a first arm extending along a first outlet axis, and the second outlet of the connector forms the terminal end of a second arm extending along a second outlet axis, the second outlet axis being fixed in relation to the inlet axis, and the first arm being articulatable relative to the second arm from a first position in parallel-spaced relation with the second arm to a second position forming a nonzero angle with respect to the second arm.

12. The apparatus of claim 11, wherein the first outlet extends to a point farther removed from the inlet than the second outlet when the first arm is in the first position relative to the second arm.

13. The apparatus of claim 11, wherein the inlet has an inner diameter, and wherein the first and second arms respectively have an inner diameter substantially equal to the inner diameter of the inlet.

14. The apparatus of claim 11, wherein the first arm articulates at a joint, and further including a grip on the first arm between the joint and the first outlet.

15. The connector of claim 11, including a threaded collar seated for rotation on the connector proximate to the inlet for securing the connector to the end of the fluid supply conduit, and including an external thread on the connector housing proximate to each outlet to respectively threadably receive the nozzles thereon.

16. The apparatus of claim 11, wherein the second outlet axis is fixed in parallel-spaced relation to the inlet axis.

* * * * *